US008740591B2

(12) United States Patent
Blythe

(10) Patent No.: US 8,740,591 B2
(45) Date of Patent: Jun. 3, 2014

(54) FOOD STORAGE BAG VACUUM PUMP

(75) Inventor: James S. Blythe, Libertyville, IL (US)

(73) Assignee: Reynolds Consumer Products LLC, Lake Forest, IL (US)

( * ) Notice: Subject to any disclaimer, the term of this patent is extended or adjusted under 35 U.S.C. 154(b) by 1272 days.

(21) Appl. No.: 12/052,523

(22) Filed: Mar. 20, 2008

(65) Prior Publication Data

US 2009/0238702 A1 Sep. 24, 2009

(51) Int. Cl.
*F04B 53/00* (2006.01)

(52) U.S. Cl.
USPC ..... 417/555.1

(58) Field of Classification Search
USPC ..... 417/234, 459, 495, 523, 545, 555.1, 417/544; 53/512, 432; 383/103; 220/212; 215/228
See application file for complete search history.

(56) References Cited

U.S. PATENT DOCUMENTS

| | | | | | |
|---|---|---|---|---|---|
| 2,436,849 | A | * | 3/1948 | Billetter | 141/65 |
| 2,649,234 | A | | 8/1953 | Taunton | 226/56 |
| 2,778,171 | A | | 1/1957 | Taunton | 53/9 |
| 2,778,173 | A | | 1/1957 | Taunton | 53/22 |
| 2,927,722 | A | | 3/1960 | Matzger | 229/62.5 |
| 3,216,172 | A | | 11/1965 | Piazze | 53/22 |
| 3,452,510 | A | * | 7/1969 | Fry | 53/88 |
| 3,672,114 | A | * | 6/1972 | Sacks | 53/88 |
| 4,018,253 | A | * | 4/1977 | Kaufman | 141/65 |
| 4,278,114 | A | * | 7/1981 | Ruberg | 141/65 |
| 4,428,478 | A | * | 1/1984 | Hoffman | 206/315.9 |
| 4,583,925 | A | | 4/1986 | Hawkins | 417/555 |
| 4,615,361 | A | | 10/1986 | Bartle, Sr. | 141/65 |
| 4,627,796 | A | * | 12/1986 | Moore | 417/313 |
| 4,843,796 | A | * | 7/1989 | Furukawa | 53/434 |
| 4,909,014 | A | * | 3/1990 | Kobayashi et al. | 53/86 |
| 4,975,028 | A | | 12/1990 | Schultz | 417/442 |
| 5,195,427 | A | | 3/1993 | Germano | 99/472 |
| 5,277,557 | A | * | 1/1994 | Cooper | 417/440 |
| 5,287,680 | A | | 2/1994 | Lau | 53/512 |

(Continued)

FOREIGN PATENT DOCUMENTS

| | | |
|---|---|---|
| CH | 108067 | 12/1924 |
| WO | WO03035506 | 5/2003 |
| WO | WO2005070137 | 8/2005 |

OTHER PUBLICATIONS

International Search Report—PCT/US2008/084481 dated Mar. 4, 2009 (4 pages).

(Continued)

*Primary Examiner* — Devon Kramer
*Assistant Examiner* — Amene Bayou
(74) *Attorney, Agent, or Firm* — Nixon Peabody LLP

(57) ABSTRACT

A vacuum pump comprises a casing having a bottom forming an aperture therein and a chamber slidably coupled within the casing. The chamber has a bottom forming an aperture therein. The vacuum pump further comprises a piston slidably coupled within the chamber. The piston includes an upper portion generally parallel to the chamber bottom. The piston further includes a hollow shaft extending from a bottom surface of the upper portion. The shaft has a first end adjacent to the upper portion and a second opposing end. The shaft is configured to fit within the chamber aperture and the casing aperture. The shaft includes at least one aperture positioned at the first end. The second end of the shaft is coupled to the casing at the casing aperture. The vacuum pump is configured to evacuate air from a flexible storage container by pushing the chamber in a downward direction.

24 Claims, 14 Drawing Sheets

(56) References Cited

U.S. PATENT DOCUMENTS

| | | | | |
|---|---|---|---|---|
| 5,299,917 | A * | 4/1994 | Schultz | 417/238 |
| 5,494,410 | A * | 2/1996 | Maier-Laxhuber et al. | 417/53 |
| 5,540,557 | A | 7/1996 | Carson | 417/53 |
| 5,544,752 | A | 8/1996 | Cox | 206/524.8 |
| 5,651,470 | A * | 7/1997 | Wu | 220/212 |
| 5,692,632 | A * | 12/1997 | Hsieh et al. | 220/212 |
| 5,931,189 | A | 8/1999 | Sweeney et al. | 137/512.15 |
| 6,044,756 | A | 4/2000 | Chang | |
| 6,045,264 | A | 4/2000 | Miniea | 383/41 |
| 6,085,906 | A | 7/2000 | Lambert | 206/524.8 |
| 6,364,622 | B1 * | 4/2002 | Lishanski et al. | 417/53 |
| 6,375,024 | B1 | 4/2002 | Park | |
| 6,491,166 | B1 | 12/2002 | Compton et al. | 206/497 |
| 6,634,384 | B2 * | 10/2003 | Skeens et al. | 137/845 |
| 6,971,417 | B2 * | 12/2005 | Deni | 141/65 |
| 7,131,250 | B2 * | 11/2006 | Kahn et al. | 53/512 |
| 7,290,660 | B2 | 11/2007 | Tilman et al. | 206/524.8 |
| 7,331,715 | B2 | 2/2008 | Miller et al. | 383/103 |
| 7,389,629 | B2 * | 6/2008 | Tretina | 53/512 |
| 2003/0136798 | A1 | 7/2003 | Wilford | 222/107 |
| 2003/0233728 | A1 * | 12/2003 | Wheeler et al. | 15/344 |
| 2005/0172577 | A1 * | 8/2005 | Oltrogge | 53/434 |
| 2006/0008187 | A1 | 1/2006 | Armstrong | 383/103 |
| 2006/0048483 | A1 | 3/2006 | Tilman et al. | 53/434 |
| 2006/0177158 | A1 | 8/2006 | Scholtis et al. | 383/100 |
| 2006/0182371 | A1 | 8/2006 | Borchardt | 383/44 |
| 2006/0193540 | A1 * | 8/2006 | Borchardt | 383/44 |
| 2006/0213148 | A1 | 9/2006 | Baptista | 53/434 |
| 2006/0254219 | A1 | 11/2006 | Alipour et al. | 53/434 |
| 2007/0092167 | A1 | 4/2007 | Tilman et al. | 383/63 |
| 2007/0101682 | A1 | 5/2007 | Tilman et al. | 53/434 |
| 2007/0101685 | A1 | 5/2007 | Tilman et al. | 53/512 |
| 2007/0154118 | A1 | 7/2007 | Tilman et al. | 383/103 |
| 2007/0172157 | A1 | 7/2007 | Buchman | 383/63 |
| 2007/0286534 | A1 | 12/2007 | Tilman et al. | 383/44 |
| 2007/0292055 | A1 | 12/2007 | Reuhs et al. | 383/103 |
| 2008/0044113 | A1 | 2/2008 | Tilman et al. | 383/103 |
| 2008/0054587 | A1 * | 3/2008 | Wu | 280/202 |

OTHER PUBLICATIONS

Written Opinion—PCT/US2008/084481 dated Mar. 4, 2009 (8 pages).

* cited by examiner

FOOD STORAGE BAG VACUUM PUMP

FIELD OF THE INVENTION

The present invention relates generally to a vacuum pump. More specifically, the present invention relates to a manually-operated vacuum pump that evacuates air from a flexible storage container as a user pushes down on the vacuum pump.

BACKGROUND OF THE INVENTION

Flexible, sealable storage containers (e.g., storage bags) are often used to store items such as food items. These bags typically include a bag body made from a thin, flexible plastic material and a resealable closure. Such bags are relatively inexpensive and easy to use. One disadvantage associated with such bags, however, is that the bags typically trap air within the bag, which may react with the food inside the bag and cause the food to spoil more quickly.

Additionally, when storage bags having a food item therein are placed in a below freezing environment, such as a freezer, air trapped within the bag may promote "freezer burn," which may also damage the food item stored within the bag. Freezer burn occurs when moisture drawn from the food item forms ice, typically on the food item. Freezer burn may be reduced when the air is substantially evacuated from the storage bag such that the sides of the bag are drawn tightly against the food item located within the bag, which inhibits or prevents moisture from being drawn out of the food item.

Existing systems for evacuating air from storage bags typically include a large device having a vacuum unit and a heat sealer structured to bond sheets of plastic together. Often, these existing systems are battery-powered or electrically-powered. These existing systems are often not portable and can be relatively expensive and/or bulky.

Additionally, existing vacuum systems evacuate air from a storage bag as the vacuum pump or portion thereof is pulled up or pushed against a spring, which pushes a piston of the vacuum system upwards. This upward-motion requires a user to exert a substantial amount of energy and/or effort as compared with, for example, merely pushing down on the vacuum pump or portion thereof. Another disadvantage of current vacuum pumps that require an upward force to evacuate air from a storage bag is that the upward force often encourages separation of the vacuum pump from the valve on the storage bag. Therefore, a vacuum pump that evacuates air during a downward push or movement is preferable as it is both more ergonomic and better cooperates to ensure a seal between the vacuum pump and the corresponding valve.

Thus, it would be desirable to provide a vacuum pump that provides for portability, utility, and ease of use in evacuating a food storage bag.

SUMMARY OF THE INVENTION

According to one embodiment of the present invention, a vacuum pump comprises a casing having a bottom forming an aperture therein. The vacuum pump further comprises a chamber slidably coupled within the casing. The chamber has a bottom forming an aperture therein. The vacuum pump further comprises a piston slidably coupled within the chamber. The piston includes an upper portion generally parallel to the chamber bottom. The piston further includes a hollow shaft extending from a bottom surface of the upper portion. The shaft has a first end adjacent to the upper portion and a second opposing end. The shaft is configured to fit within the chamber aperture and the casing aperture. The shaft includes at least one aperture positioned at the first end. The second end of the shaft is coupled to the casing at the casing aperture. The vacuum pump is configured to evacuate air from a flexible storage container by pushing the chamber in a downward direction.

According to another embodiment of the present invention, a vacuum pump comprises a removable fluid separator. The vacuum pump further comprises a casing coupled to the fluid separator. A bottom of the casing has a casing aperture formed thereon. The vacuum pump further comprises a chamber slidably coupled within the casing. A bottom of the chamber has a chamber aperture formed thereon. The vacuum pump further comprises a piston slidably coupled within the chamber. A hollow shaft of the piston extends through the casing aperture and the chamber aperture. The vacuum pump is configured to evacuate air from a flexible storage container by moving the piston in an upward direction relative to the chamber.

According to yet another embodiment of the present invention, a vacuum system comprises a vacuum pump having a casing. A bottom of the casing has a casing aperture formed thereon. The vacuum pump further has a chamber slidably coupled within the casing. A bottom of the chamber has a chamber aperture formed thereon. The vacuum pump further has a piston slidably coupled within the chamber. A hollow shaft of the piston extends through the casing aperture and the chamber aperture. The vacuum system further comprises a removable fluid separator having one or more apertures formed on a bottom face. The fluid separator is coupled to the casing. The vacuum system further comprises a flexible storage container defining an interior space configured to be in fluid communication with the one or more apertures formed on the bottom face of the fluid separator.

The above summary of the present invention is not intended to represent each embodiment or every aspect of the present invention. Additional features and benefits of the present invention are apparent from the detailed description and figures set forth below.

Figure 1B:
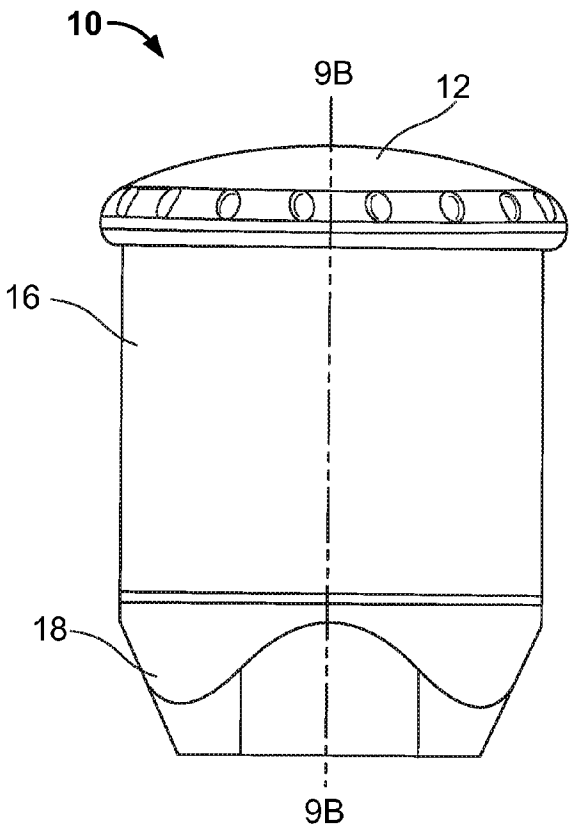
FIG. 1*b* is a side perspective view of the vacuum pump of FIG. 1*a* in a compressed position.

While the invention is susceptible to various modifications and alternative forms, specific embodiments are shown by way of example in the drawings and are described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATED EMBODIMENTS

Figure 1A:
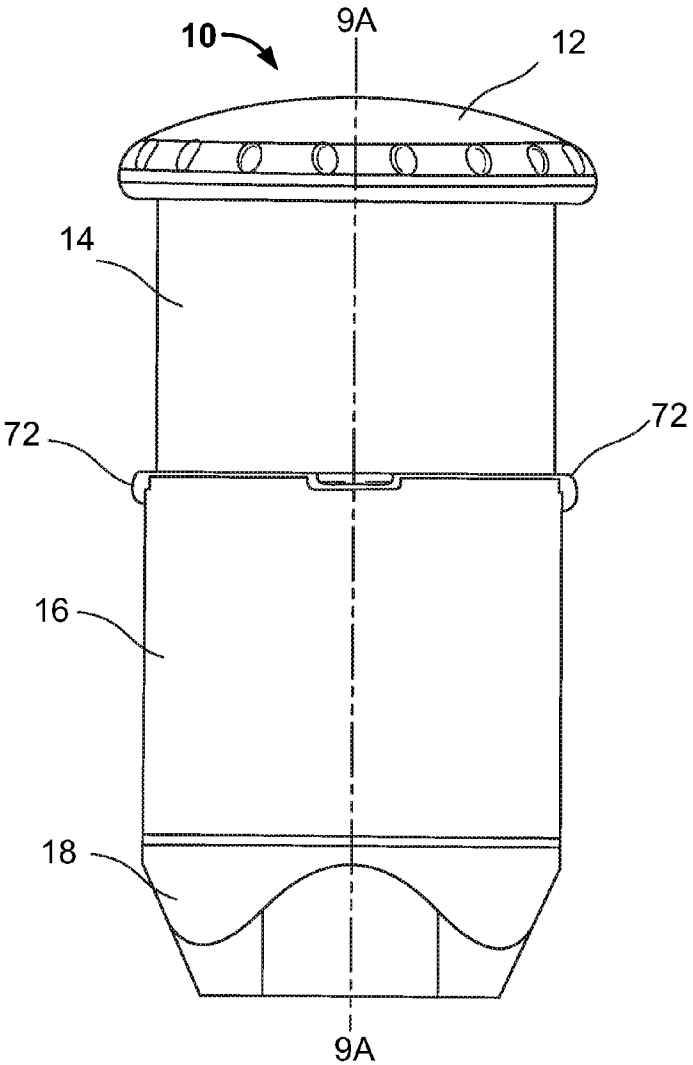
FIG. 1*a* is a side perspective view of a vacuum pump in an expanded position according to one embodiment.

Referring to FIGS. 1*a*, 1*b*, a vacuum pump 10 is shown according to one embodiment of the present invention. The vacuum pump 10 includes a lid 12, a chamber 14, a casing 16, and a fluid separator 18. To evacuate air from a flexible storage bag, the fluid separator 18 is placed over a one-way valve on the flexible storage bag (see FIG. 10), and the vacuum pump 10 is pushed down in the direction of Arrow A from an expanded position (see FIG. 1*a*) to a compressed position (see FIG. 1*b*).

The casing 16 serves as a type of guard to protect a user's fingers and/or hands from being caught between other parts of the vacuum pump 10 while using or compressing the vacuum pump 10. The casing 16 also enhances the aesthetic value of the vacuum pump 10.

Figure 2:
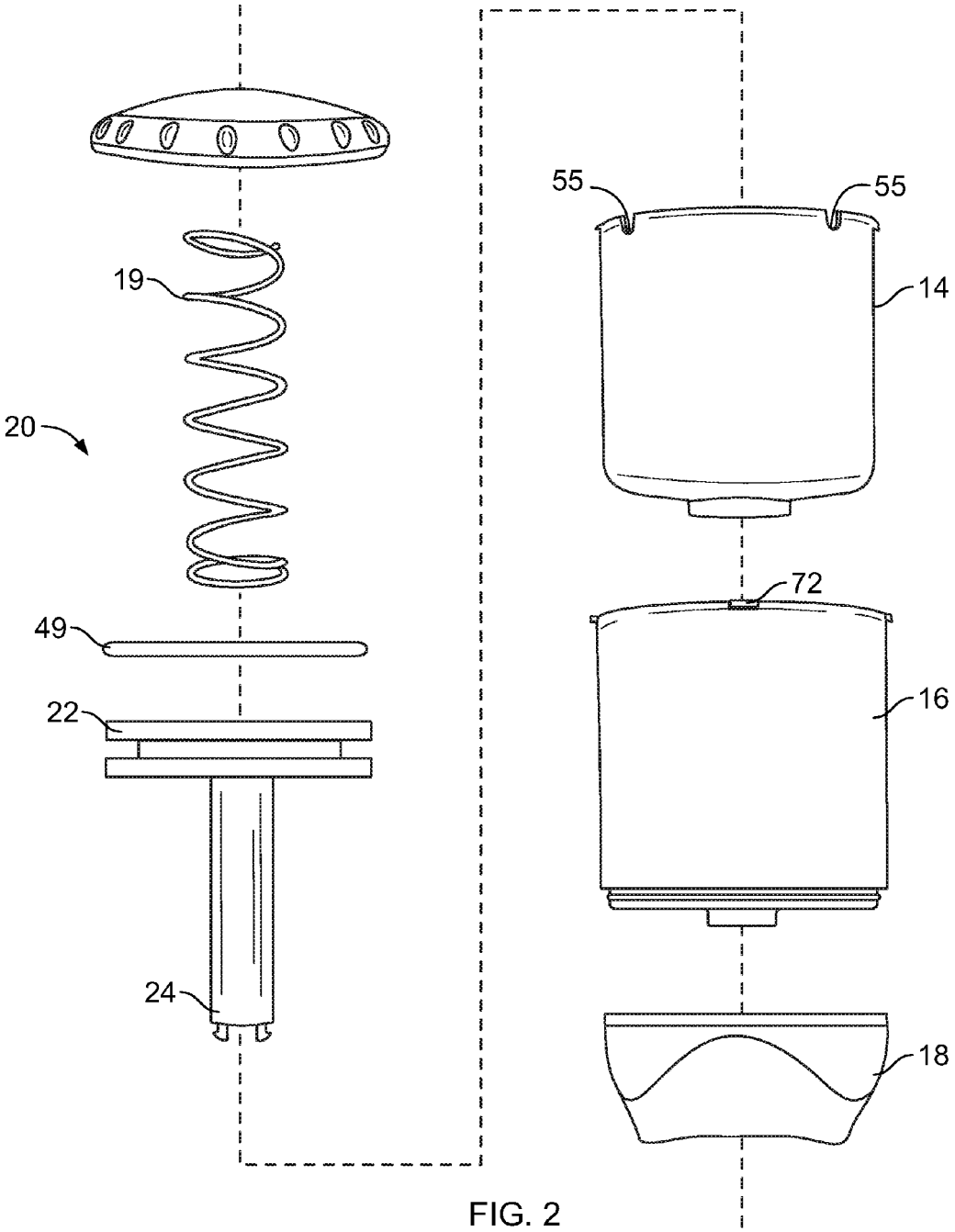
FIG. 2 is an exploded view of the vacuum pump of FIG. 1.

FIG. 2 illustrates an exploded view of the vacuum pump 10 of FIGS. 1*a*, 1*b*. As shown in FIG. 2, the vacuum pump 10 includes a spring 19 and an internal piston 20. The piston 20 has an upper portion 22 and a hollow shaft 24. The shaft 24 is sized to fit snugly through apertures 26, 28 formed at respective bottom portions 30, 31 of the chamber 14 and the casing 16 (see FIGS. 4*a*, 4*b*, 7*b*).

Figure 3A:
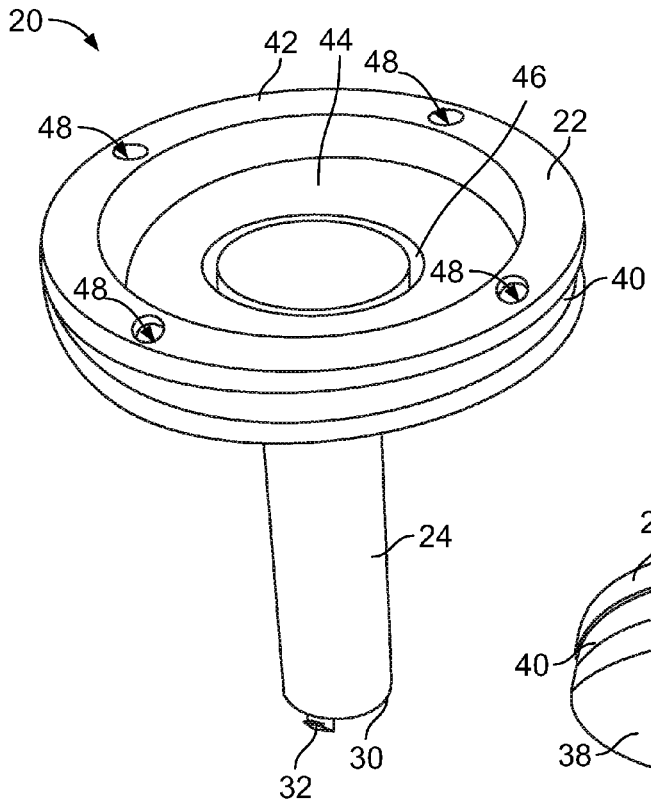
FIG. 3*a* is a top perspective view of a piston according to one embodiment.
Figure 3B:
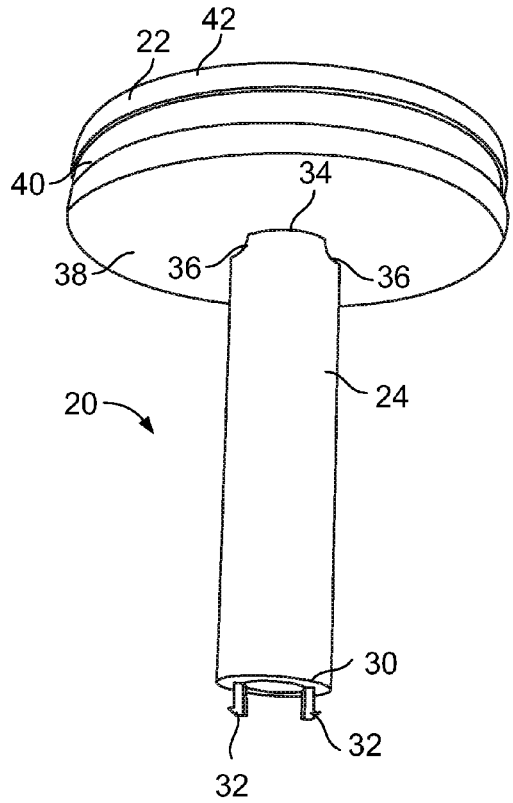
FIG. 3*b* is a bottom perspective view of the piston of FIG. 3*a*.

FIGS. 3*a*, 3*b* show the piston 20 in greater detail. A bottom end 30 of the shaft 24 includes one or more prongs 32 for engaging an outer portion of the aperture 28 of the casing 16 (see FIG. 7*b*). An opposing top end 34 of the shaft 24 includes one or more apertures 36. Although the illustrated embodiment shows the shaft 24 having two prongs 32 and two apertures 36, it is contemplated that the shaft 24 may include other numbers of prongs 32 and/or apertures 36.

The upper portion 22 of the piston 20 includes a generally flat lower disc portion 38 adjacent to the shaft 24, a notched side portion 40, and an upper rim portion 42 generally parallel with an outer edge of the lower disc portion 38. A top side 44 of the lower disc portion 38 includes an indent 46 for engaging the spring 19 (see FIG. 2). The rim portion 42 forms a plurality of apertures 48. Although in the illustrated embodiment, the rim portion 42 forms four uniformly-spaced apertures 48, it is contemplated that the rim portion 42 may include a different number of apertures, non-uniformly-spaced apertures, or combinations thereof. It is also contemplated that the apertures may have shapes other than the generally round shape of the apertures 48 shown in FIG. 3*a*.

In the illustrated embodiment, an O-ring 49 (see FIG. 2) is positioned generally adjacent to the notched side portion 40 and between the lower disc portion 38 and the rim portion 42. As described in more detail below, the O-ring 49 acts like a one-way check valve, sealing the apertures 48 when the pump 10 is pushed downward into the compressed position of FIG. 1*b* and opening the apertures 48 when the spring 19 pushes the vacuum pump 10 back up into the expanded position of FIG. 1*a*.

Figure 4A:
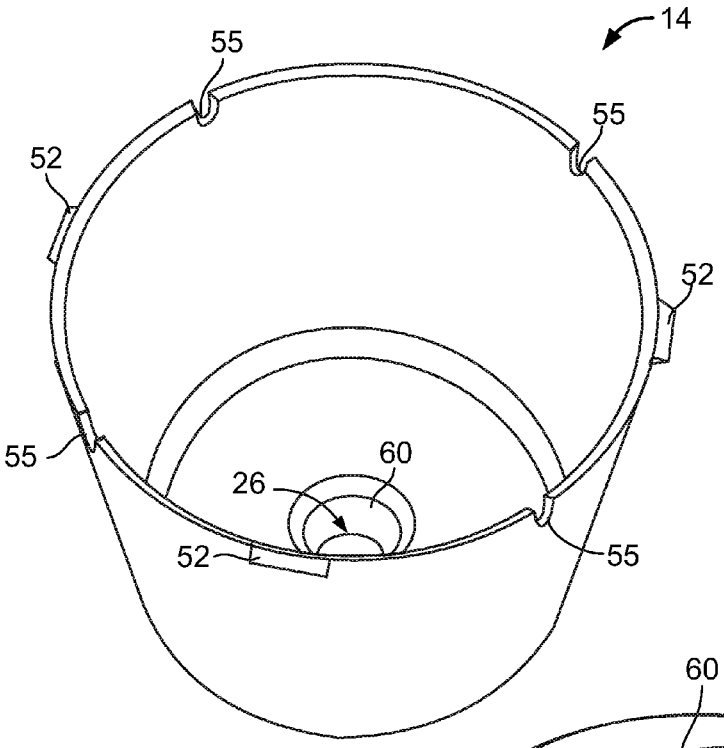
FIG. 4*a* is a top perspective view of a casing according to one embodiment.
Figure 4B:
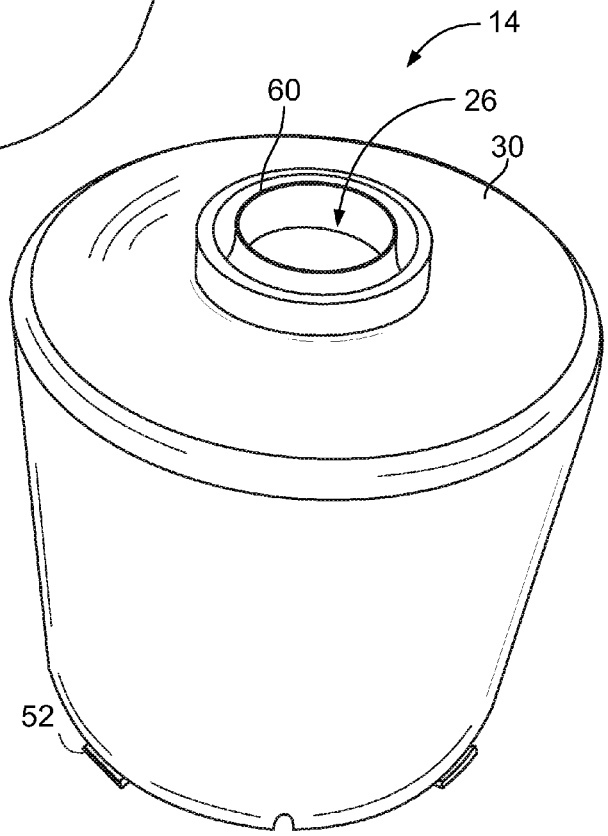
FIG. 4*b* is a bottom perspective view of the casing of FIG. 4*a*.

FIGS. 4*a*, 4*b* illustrate the chamber 14 in greater detail. As shown in FIG. 4*a*, the chamber 14 includes a locking feature for mating with the lid 12 such that the lid 12 may be attached thereto. In the illustrated non-limiting embodiment, the locking feature includes a plurality of projections 52 positioned around the outer perimeter of an upper portion 54 of the chamber 14.

Figure 5:
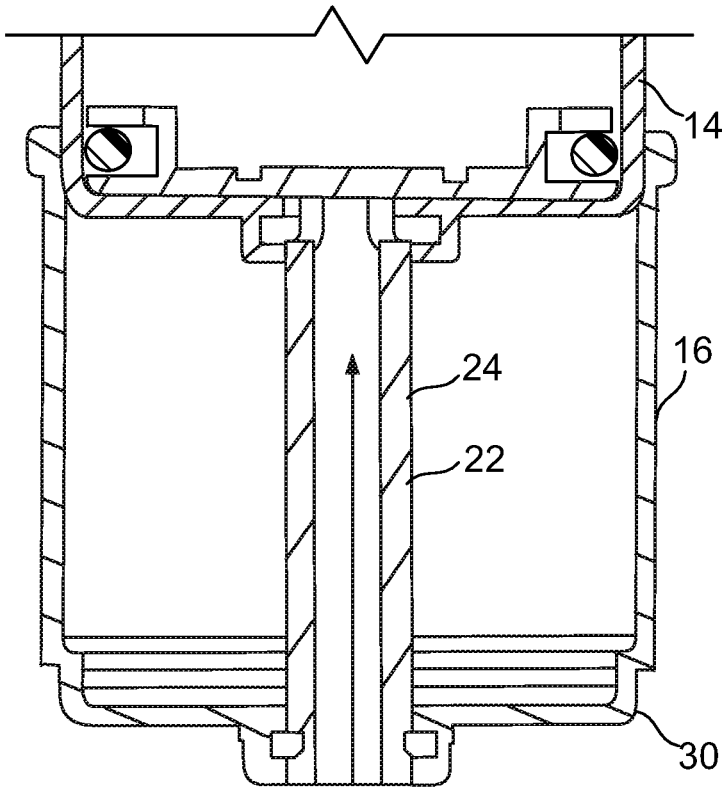
FIG. 5 is a cross-sectional view of the chamber of FIGS. 4*a*, 4*b* and the piston of FIGS. 3*a*, 3*b*.

As shown in FIGS. 4*a*, 4*b*, 5, the bottom 30 of the chamber 14 forms an aperture 26 for receiving the shaft 24 of the piston 20 (see FIGS. 3*a*, 3*b*). The aperture 26 is surrounded by a flap-seal 60 for forming a flexible, tight seal between the shaft 24 and the chamber 14. In one embodiment, the flap-seal 60 is a generally thin, polymeric flap molded into the casing 16. The shape and dimensions of the flap-seal 60 assist in sealing the flap-seal 60 around the shaft 24. In other embodiments, an O-ring or other like feature may be used instead of the flap-seal 60.

Figure 6A:
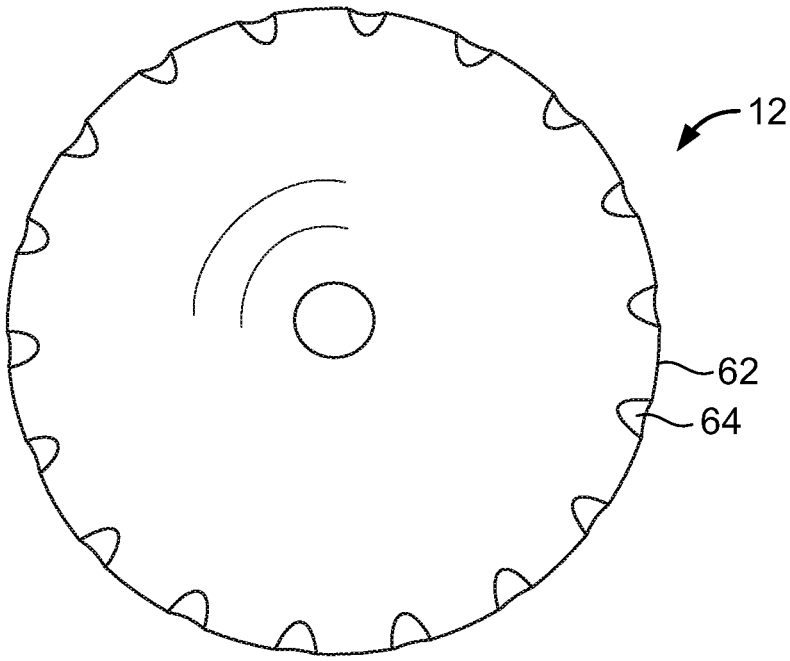
FIG. 6*a* is a top view of a lid according to one embodiment.
Figure 6B:
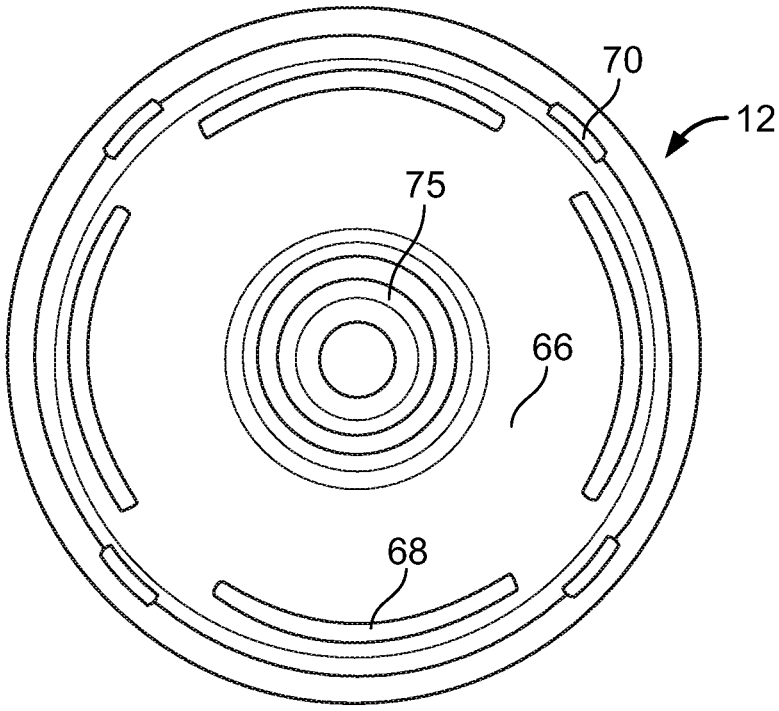
FIG. 6*b* is a bottom view of the lid of FIG. 6*a*.

Turning now to FIGS. 6*a*, 6*b*, the lid 12 is shown in more detail. As shown in FIG. 6*a*, an outer portion 62 of the lid 12 includes a plurality of grooves 64 positioned generally around the circumference of the lid 12. The grooves 64 assist a user in gripping the lid 12. As shown in FIG. 6*b*, an inner portion 66 of the lid 12 includes notches 68 for receiving the locking feature (e.g., the plurality of projections 52) of the chamber 14 such that the lid 12 may be attached to the chamber 14. The inner portion 66 of the lid 12 also includes a compressing feature for mating with a corresponding compressing feature positioned on the casing 16 to keep the vacuum pump 10 in the compressed position of FIG. 1*b*. In the illustrated embodiment, the compressing feature of the lid 12 includes a plurality of projections 70 each of which includes a space positioned above for receiving a corresponding plurality of projections 72 on an outer surface of the casing 16 (see FIG. 2). When the projections 72 of the casing 16 are positioned above the projections 70 of the lid 12, the vacuum pump 10 is maintained in the compressed position of FIG. 1*b*. The inner portion 66 of the lid 12 further includes a feature 75 for assisting in maintaining the spring 19 in a fixed, upright position. The feature 75 may be raised, notched, a combination thereof, or the like.

Figure 7A:
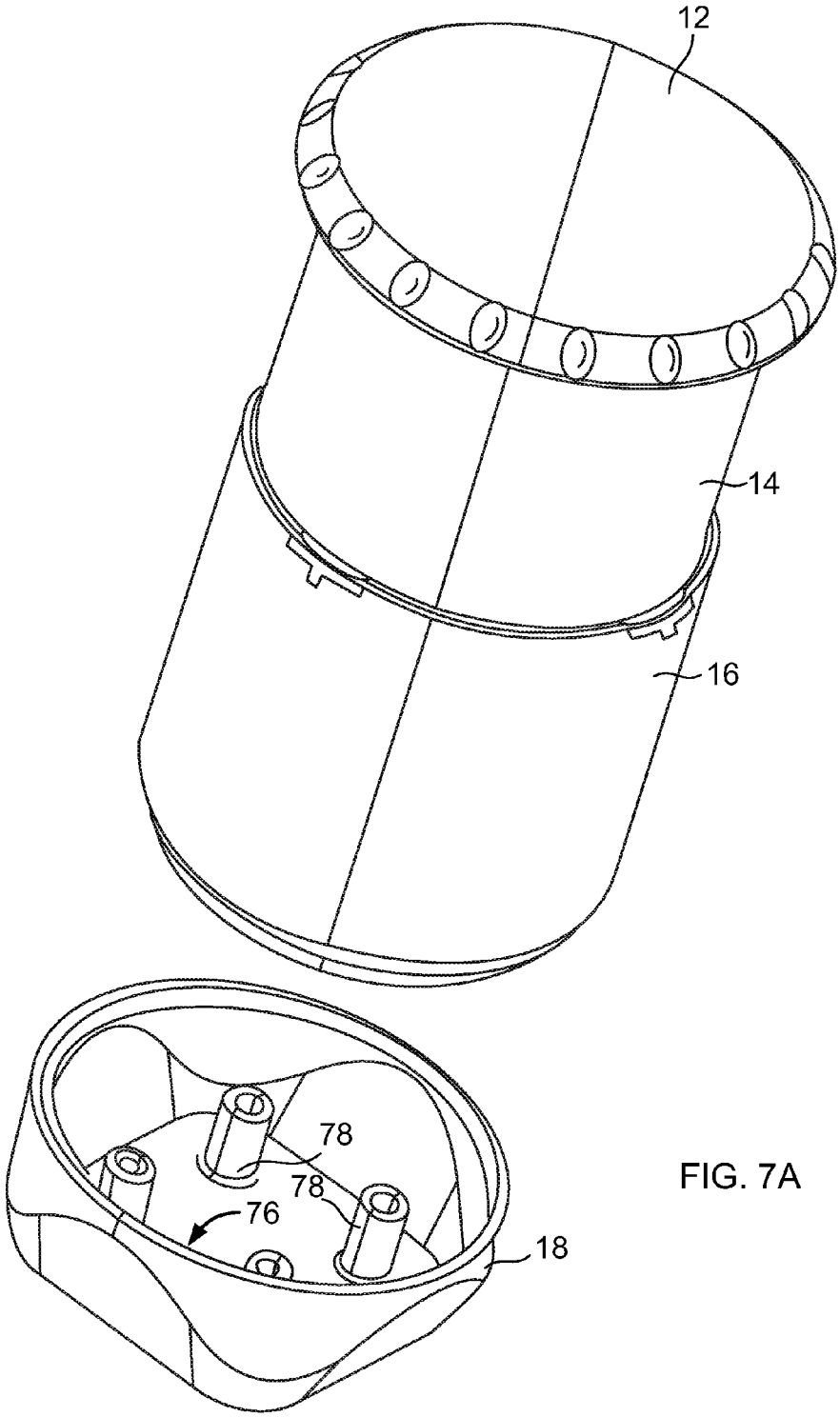
FIG. 7*a* is a top perspective view of the vacuum pump of FIGS. 1*a*, 1*b* with the fluid separator being unattached.
Figure 7B:
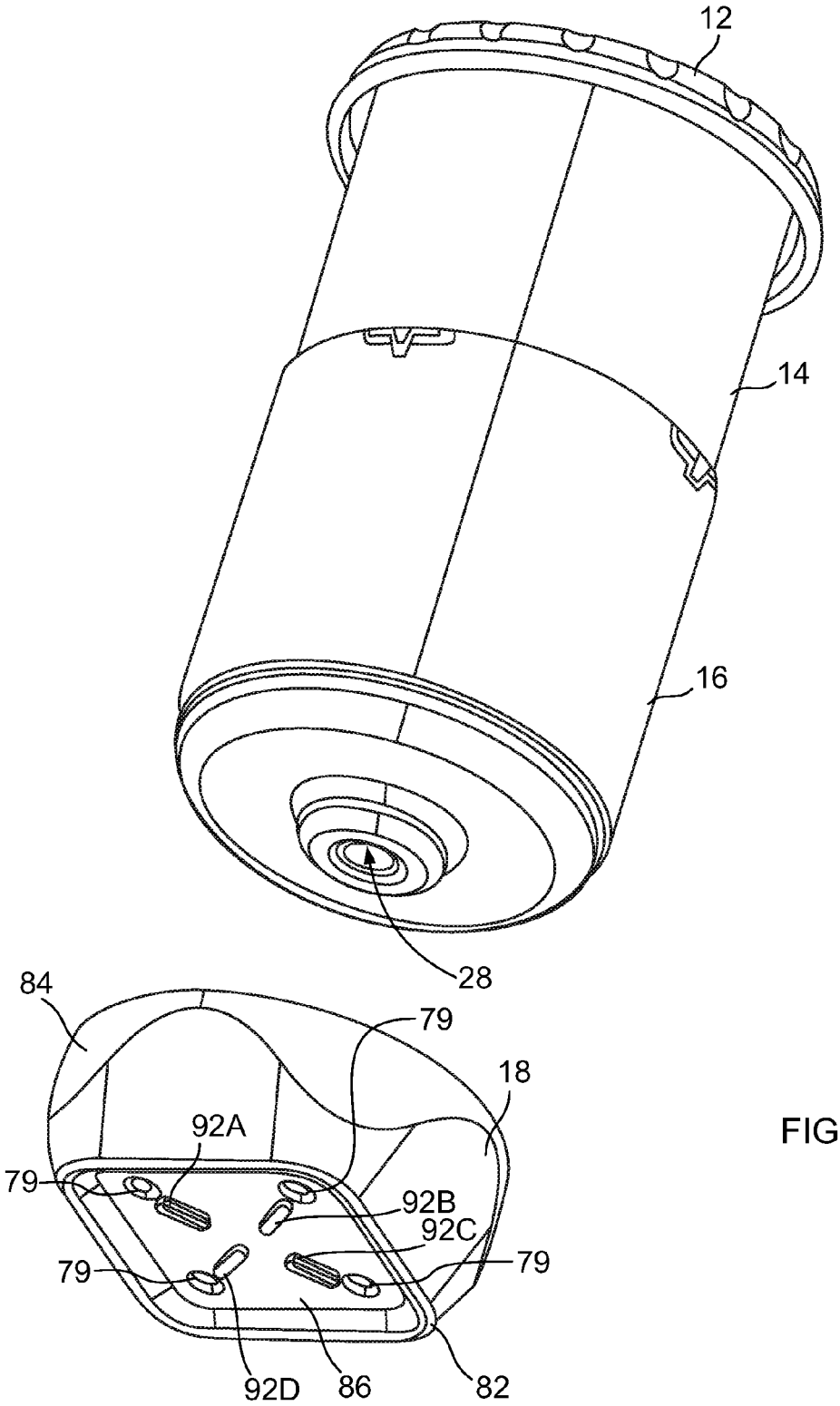
FIG. 7*b* is a bottom perspective view of the vacuum pump and fluid separator of FIG. 7*a*.
Figure 7C:
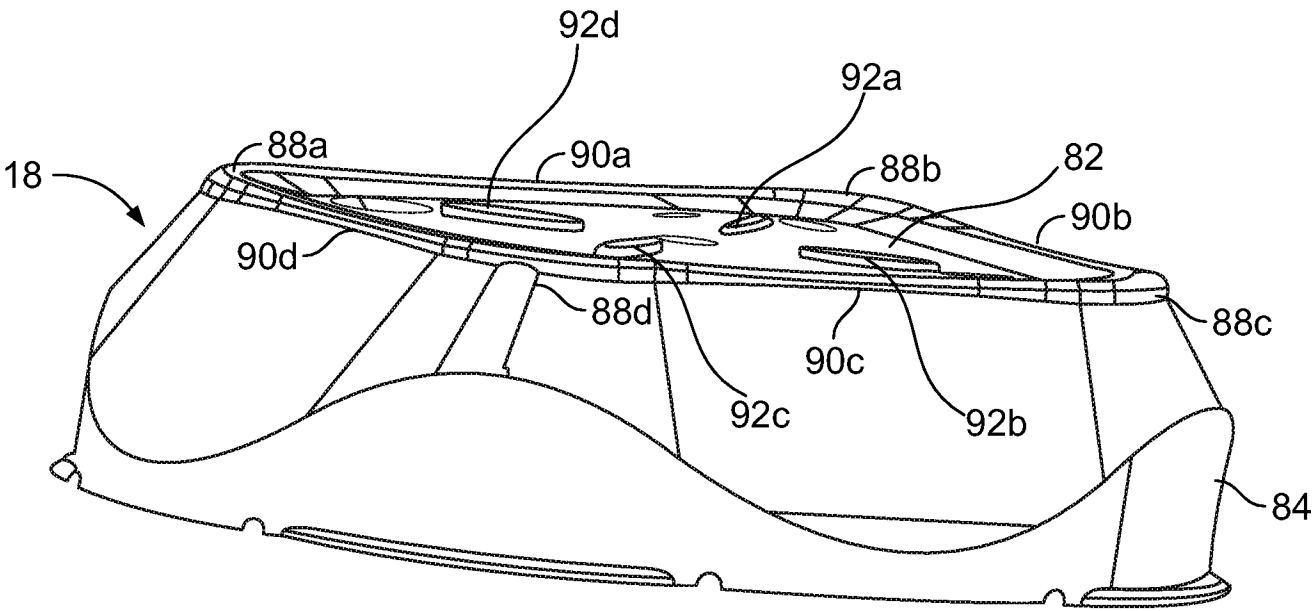
FIG. 7*c* is a side perspective view of the fluid separator of FIGS. 7*a-b*.

FIGS. 7*a*-7*c* illustrate the fluid separator 18 according to one embodiment. Although not required, the fluid separator 18 is useful in inhibiting or preventing liquid that is accidentally pulled out of the storage bag from moving up into other portions of the vacuum pump 10 (e.g., the chamber 14, the casing 16, the shaft 24). Thus, the fluid separator 18 assists in maintaining hygienic conditions in the vacuum pump 10.

Additionally, it is contemplated that the fluid separator 18 may be easily detachable from the remaining portions of the vacuum pump 10 so that the fluid separator 18 may be easily and/or frequently cleaned. The fluid separator 18 may be attached to the casing 16 by a snap-fit, by being screwed-on, or by other attaching methodology. The fluid separator 18 may also be attached to the casing 16 in other suitable ways. In some embodiments, the fluid separator 18 may be made from a material that is dishwasher safe such as, for example, a polymeric material.

As shown in FIG. 7*a*, the fluid separator 18 includes a plurality of hollow pegs 78 projecting generally upwardly from apertures 79 (see FIG. 7*b*) formed on a bottom face 82 of the fluid separator 18 to an interior 76 of the fluid separator 18. In the event that fluid is accidentally sucked up through a valve of a storage bag, the fluid generally comes up through the hollow pegs 78 with the air. Gravity then causes the fluid to spill over the outside of the pegs 78 and to gather in the interior 76 of the fluid separator 18. The air that is pulled out from the storage bag, however, continues up through the remaining portions of the vacuum pump 10, as described in more detail below.

The distance between a top of the pegs 78 and the casing 16 may vary. Increasing the length of the pegs 78 allows for more liquid to be stored in the interior 76 of the fluid separator 18. Increasing the distance also makes it less likely that liquid will be pulled up into other portions of the vacuum pump 10. However, the greater the distance between the pegs 78 and the casing 16, the more effort (e.g., more pumps) is required to draw air out from the storage bag.

FIGS. 7*b*, 7*c* show the bottom face 82 and a side portion 84 of the fluid separator 18. In the illustrated embodiment, the bottom face 82 is generally square in shape. It is contemplated, however, that the bottom face may have other shapes including rectangular, other polygonal, circular (see FIG. 8*a*), oval, or the like. For example, the shape may be selected based on the shape and type of valve included on the storage bag with which the vacuum pump is to be used.

The bottom face 82 is outlined by a raised border 86 for inhibiting or preventing embossed channels (e.g., embossed channels 87 of FIG. 10) on the storage bag from becoming crushed when the vacuum pump 10 (e.g., the bottom face 82 of the fluid separator 18) is pressed against the storage bag and/or embossed channels. Typical storage bags suitable for use with vacuum pumps utilize embossed channels to ensure that air may be evacuated fully from the bag without sealing off an interior space (e.g., air pocket) within the bag. The interior space may become sealed off when film layers of the bags are sealed together as a result of the vacuum use. When the interior space becomes sealed off, air within the interior space has no way of reaching the valve of the bag. Thus, crushing the embossed channels on the storage bag makes it difficult or impossible to draw air from the storage bag. In the illustrated embodiment, the corners 88*a-d* of the bottom face 82 are slightly higher than the sides 90*a-d* of the bottom face 82 (see FIG. 7*c*). The height difference between the corners 88*a-d* and the sides 90*a-d* of the bottom face 82 may range from about 0.1 mm to about 1 mm. In other embodiments, the height difference is less than about 0.5 mm. In another embodiment, the border 86 includes a plurality of raised portions.

The transition between the varying heights and/or raised portions of the border 86 of the bottom face 82 of the fluid separator 18 are generally smooth and/or curved. For example, in the illustrated embodiment of FIG. 7*c*, the border 86 has a generally sinusoidal profile. Unlike existing vacuum systems, which generally use an O-ring or other more complex and/or costly elastomeric device to seal the vacuum pump to the storage bag, the vacuum pumps described herein utilizes a low-cost molding on the fluid separator itself in combination with the film of the storage bag. Thus, the fluid separator of the embodiments described herein is generally easier and less expensive to manufacture than that of existing vacuum systems.

In one non-limiting example, a top film panel on a valve must bend outward to allow air to escape the bag. To assist in allowing the valve to open, the bottom face 82 of the illustrated embodiment further includes raised channels 92*a-d*. It is contemplated that other and/or different features may also or alternatively be included on the bottom face 82 to assist in preventing or inhibiting the embossed channels of the storage bag from becoming crushed.

It is contemplated that the vacuum pump 10 of the embodiments of the present invention may include interchangeable fluid separators. For example, the fluid separator may be interchanged depending on the type of storage bag and corresponding valve with which the vacuum pump 10 is to be used.

Figure 8A:
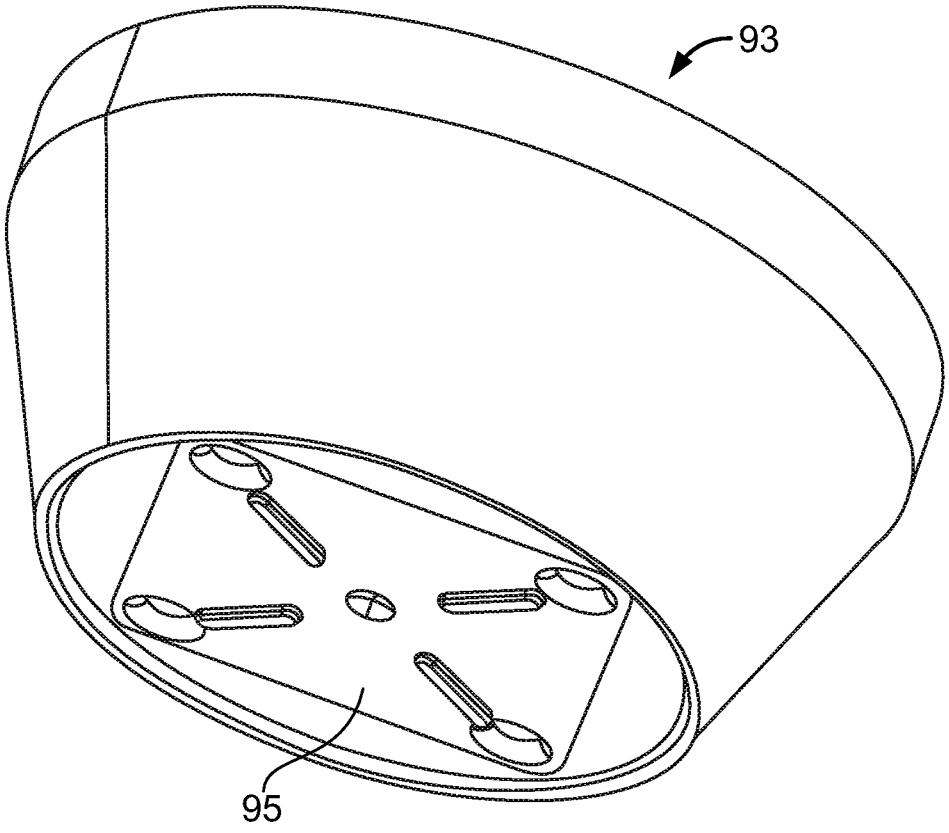
FIG. 8*a* is a side perspective view of a fluid separator according to another embodiment.

FIGS. 8*a-e* illustrate other, non-limiting examples of fluid separators that may be used with the embodiments of the present invention. For example, FIG. 8*a* shows a fluid separator 93 having a generally round face 95. The other features and characteristics of the fluid separator 93 of FIG. 8*a* may be similar to those of the fluid separator 18 of FIGS. 7*a-c*.

Figure 8C:
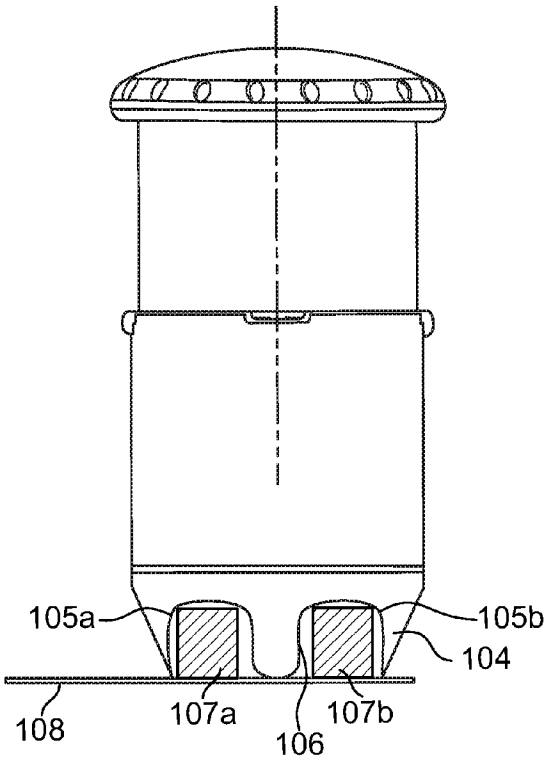
FIGS. 8*b-e* are side views of fluid separators and storage bags according to other embodiments.
Figure 8B:
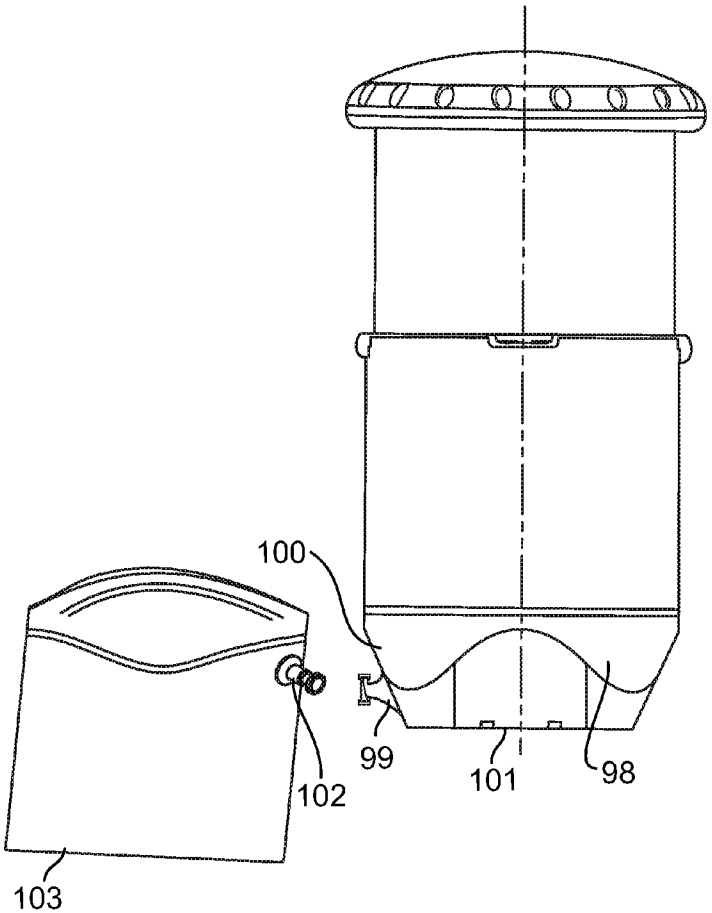

FIG. 8*b* illustrates a fluid separator 98 having a dock point 99 extending from a sidewall 100. Unlike the bottom face 82 of the fluid separator 18 of FIGS. 7*a-c*, a bottom face 101 of the fluid separator 98 generally does not include any openings. Rather, air is evacuated from a valve 102 of a storage bag 103 via the dock point 99. This type of fluid separator may be desirable to evacuate air from storage bags such as the bag 103 shown in FIG. 8*b*, where the valve 102 is generally positioned at or near the side of the storage bag.

FIG. 8*c* illustrates a fluid separator 104 having grooves 105*a*, 105*b* formed on a bottom face 106 of the fluid separator 104. The grooves 105*a*, 105*b* are configured to receive one or more valves 107*a*, 107*b* protruding from a storage bag 108. It is contemplated that the grooves 105*a*, 105*b* may have shapes other than those shown in FIG. 8*c*. It is also contemplated that the fluid separator 104 may have different number of grooves 105*a*, 105*b*.

Figure 8E:
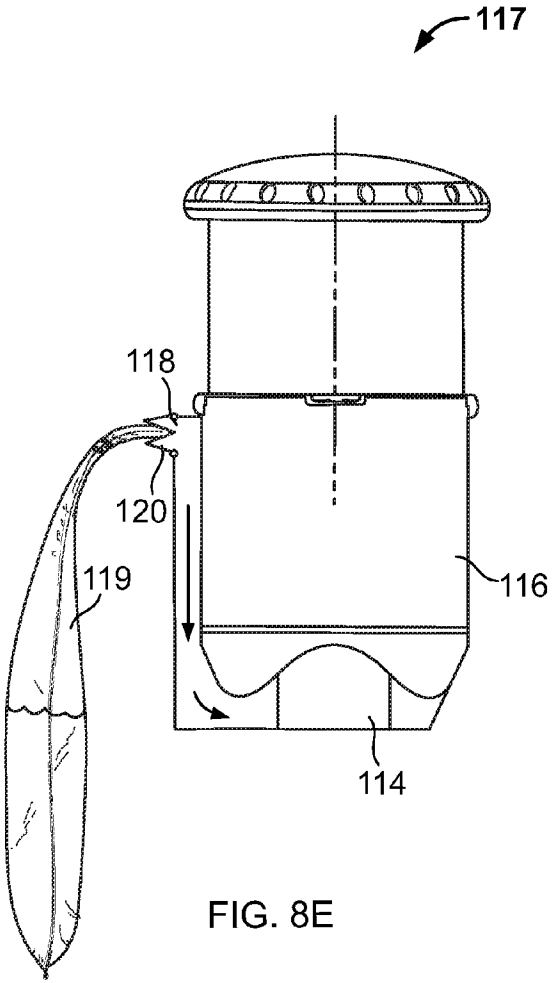
Figure 8D:
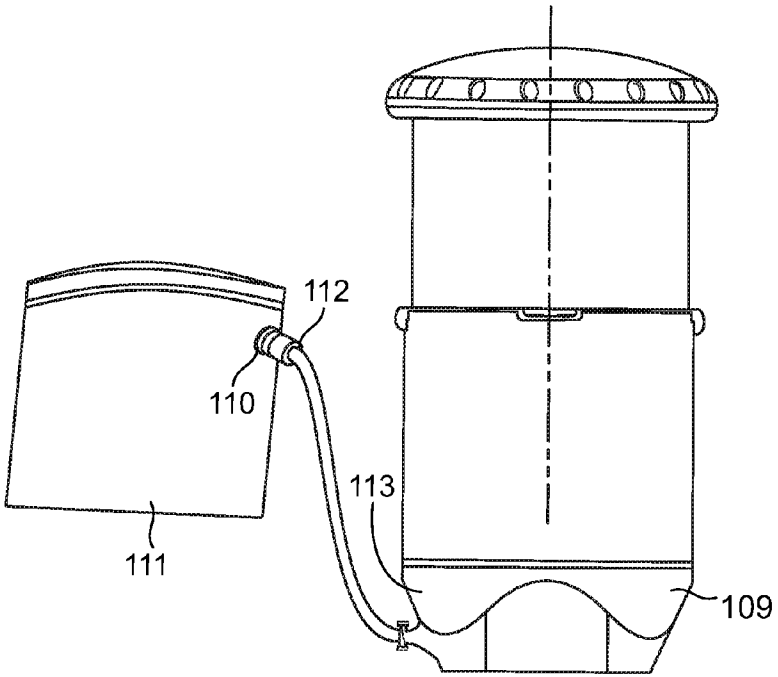

FIG. 8*d* shows a fluid separator 109 being connected to a valve 110 of a storage bag 111 by a hose 112. The hose 112 may be connected to a sidewall 113 of the fluid separator 109 (as shown) or a bottom face (not shown) of the fluid separator 109. It may be desirable for the hose 112 to be connected to the sidewall 113 such that a user may more easily push the chamber of the vacuum pump down against a flat surface. The hose 112 may be connected to the fluid separator 109 using any suitable attachment methodology.

Finally, FIG. 8*e* shows a fluid separator 114 extending up a casing 116 of a vacuum pump 117. The fluid separator 114 includes a clamp 118 for maintaining a storage bag 119 between a top 120 of the fluid separator 114 and the clamp 118. The clamp 118 is beneficial because it allows for a precise amount of pressure to be applied to the storage bag 119. Thus, a user need not be concerned about applying too much pressure and crushing embossed channels on the storage bag 119 or applying too little pressure and not adequately sealing the storage bag 119 to the vacuum pump 117. The embodiment of FIG. 8*e* may also be desirable because air is pulled from the top of the storage bag 117. Furthermore, gravity maintains fluids low in the storage bag 119, and, thus, the fluids are less likely to be pulled up into the vacuum pump 117.

In another embodiment (not shown), a slider of a storage bag may be used as a one-way valve. The fluid separator of the vacuum pump may be shaped such that the fluid separator may fit around the slider and evacuate air from the bag through the slider.

Figure 9B:
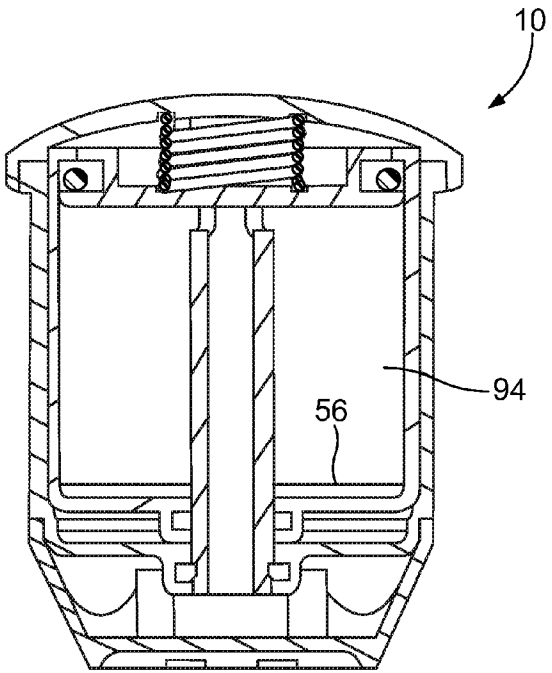
FIG. 9*b* is a cross-sectional view of the vacuum pump of FIG. 1*b* taken generally along line 9*b*-9*b*.
Figure 9A:
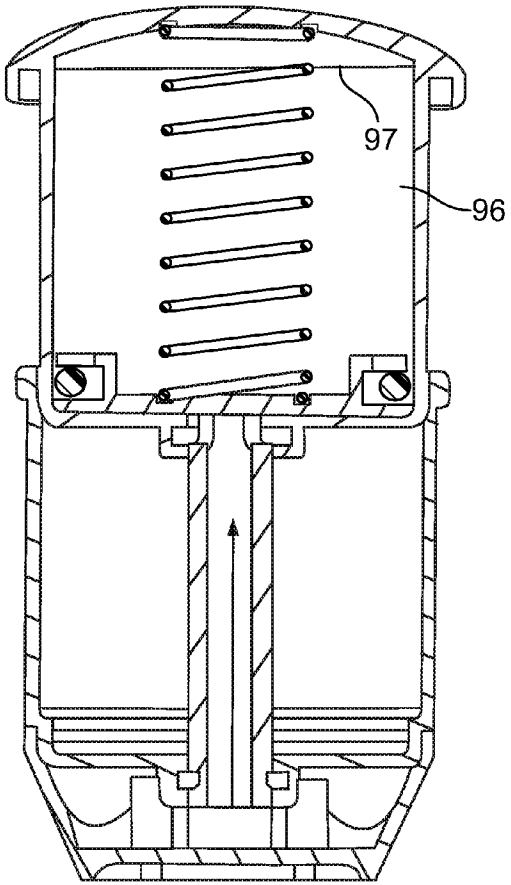
FIG. 9*a* is a cross-sectional view of the vacuum pump of FIG. 1*a* taken generally along line 9*a*-9*a*.

To use the vacuum pump 10 of the illustrated embodiments, the vacuum pump 10 is generally placed in the expanded position of FIG. 1*a*. FIG. 9*a* is a cross-sectional view of the vacuum pump 10 in the expanded position of FIG. 1*a*. In one embodiment, when the lid 12 is turned relative to the casing 16, the projections 72 of the casing 16 are released from the projections 70 of the lid 12, and the spring 19 forces the vacuum pump 10 to the expanded position of FIGS. 1*a*, 9*a*.

Figure 10:
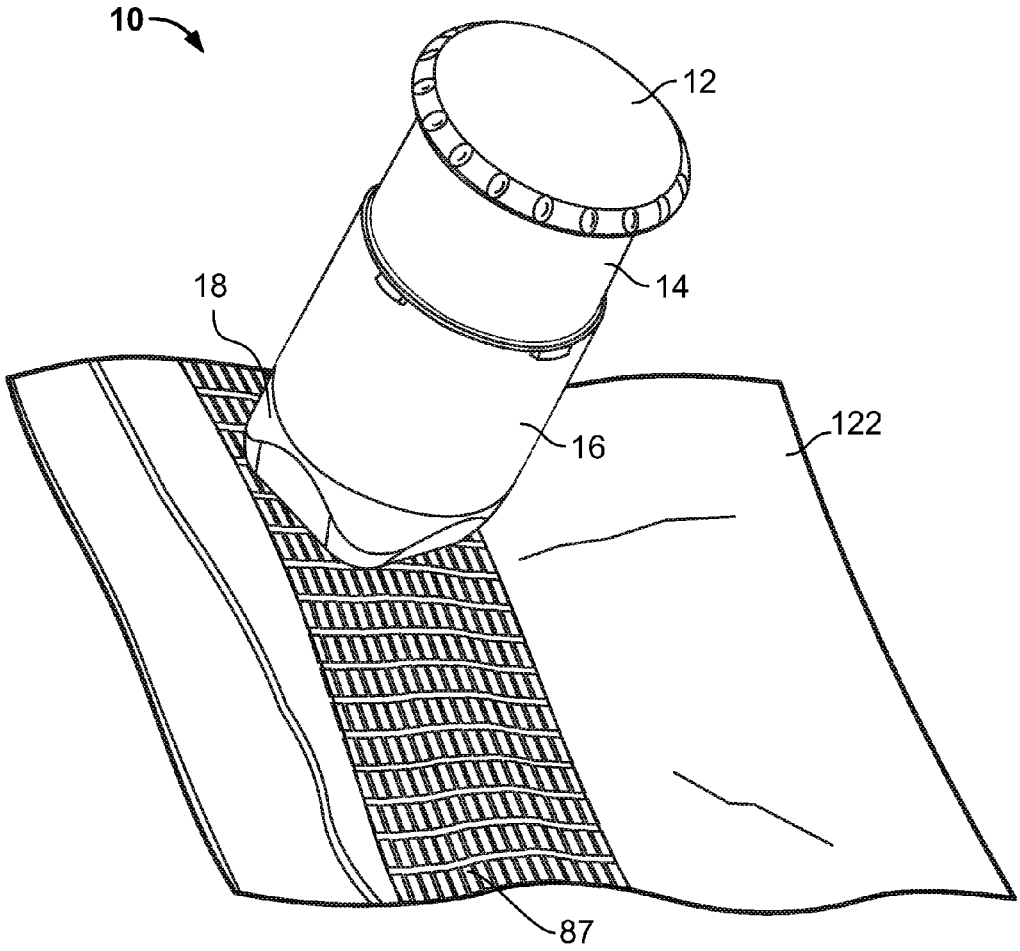
FIG. 10 is a top perspective view of the vacuum pump of FIGS. 1*a*, 1*b* being placed over a one-way valve on a storage bag.

A user may then place the bottom face 82 of the fluid separator 18 over a one-way valve of a flexible storage bag 122, as shown in FIG. 10. FIG. 10 illustrates a vacuum system including the vacuum pump 10 and a removable fluid separator 18, as described above, and a flexible storage container (e.g., storage bag) 122. The storage bag 122 may be a slider bag or a press-to-close bag. The storage bag 122 may be formed of a top and a bottom polymeric film sealed to define an interior space that is in fluid communication with the apertures 79 on the bottom face 82 of the fluid separator 18. The storage bag 122 may include a one-way valve that is configured to be coupled to the fluid separator 18. The one-way valve may be any suitable type of one-way valve, including, but not limited to, a two-layered valve, a reed valve, a ball valve, a lift-check valve, or the like. Exemplary, non-limiting valves suitable for use with the embodiments of the present invention are disclosed in U.S. Pat. Nos. 7,290,660 and 7,331,715 and U.S. Patent Application Publication Nos. 2006/0193540 and 2007/0292055, the entire contents of all of which are hereby incorporated by reference. Storage bags used with the embodiments of the present may be partially embossed, as shown, for example, in FIG. 10, or fully embossed (not shown).

To evacuate air from the flexible storage bag 122, the user may push down on the lid 12 of the vacuum pump 10. A resulting downward movement of the chamber 14 causes the piston 20 to move upwardly relative to the chamber 14. Thus, a sub-chamber 94 (see FIG. 9*b*) positioned between the lower disc portion 38 of the piston 20 and the bottom 56 of the chamber 14 expands, thereby causing air to be pulled air out of the storage bag, through the fluid separator 18 and the hollow shaft 24 of the piston 20, and into the sub-chamber 94 through the apertures in the shaft 24.

As the vacuum pump 10 moves back and forth between the expanded position (FIGS. 1*a*, 9*a*) and the compressed position (FIGS. 1*b*, 9*b*), the apertures 48 and the O-ring 49 of the piston 20 work like a one-way valve. Specifically, as the chamber 14 moves downwardly, the apertures 48 in the rim portion 42 of the piston 20 become sealed by the O-ring 49, thereby preventing air from being drawn into the sub-chamber 94 from a second sub-chamber 96 (see FIG. 9*a*) positioned between the disc portion 38 of the piston 20 and a top 97 of the chamber 14. As the spring 19 pushes the disc portion 38 downward back into the expanded position of FIGS. 1*a*, 9*a*, the O-ring 49 backs away from the apertures 48 of the rim portion 42, thereby allowing the air from the sub-chamber 94 to vent into the second sub-chamber 96. Air vents out of the chamber 14 through notches 55 (see FIG. 2). Additionally, when the vacuum pump 10 is pushed downward, air within the casing 16 pushes up against the flap-seal 60. This seals the flap-seal 60 to the shaft 24.

Because the vacuum pump 10 of the embodiments of the present invention is pushed downward to evacuate air from a storage bag, a user may use his or her weight to press the vacuum pump 10 downward, thereby requiring substantially less effort to evacuate air from the storage bag. When used with a typically-sized household storage bag, the vacuum pump 10 may be cycled between about 5 to about 20 times between an expanded position (FIGS. 1*a*, 9*a*) and a compressed position (FIGS. 1*b*, 9*b*) to remove most of the air from the storage bag, thereby creating negative pressure within the storage bag. The downward pressure exerted on the vacuum pump 10 further aids in sealing the vacuum pump 10 against the valve of the storage bag.

It is contemplated that the vacuum pump 10 may not include a spring 19. In such an embodiment, a user would be required to pull the chamber 14 back up to the expanded position of FIGS. 1*a*, 9*a*.

The vacuum pump 10 of the embodiments described herein is beneficial because it does not require tools for assembly. Thus, the vacuum pump 10 may be quickly and easily assembled.

The vacuum pump 10 of the embodiments described herein may be packaged and sold in a variety of ways. For example, the vacuum pump 10 may be sold by itself. The vacuum pump 10 may also be sold in a package including flexible storage containers (e.g., storage bags) that may be used with the vacuum pump 10. In one embodiment, the vacuum pump 10 is sold with storage bags of various sizes. Alternatively or additionally, the vacuum pump 10 may be packaged and sold with more than one fluid separator so that the vacuum pump may be used with various types of storage bags having various types of valves.

While the invention is susceptible to various modifications and alternative forms, specific embodiments and methods thereof have been shown by way of example in the drawings and are described in detail herein. It should be understood, however, that it is not intended to limit the invention to the particular forms or methods disclosed, but, to the contrary, the intention is to cover all modifications, equivalents, and alternatives falling within the spirit and scope of the invention.

What is claimed is:

1. A vacuum pump comprising:

a casing having a bottom forming an aperture therein;

a chamber slidably coupled within the casing, the chamber being positioned generally inside of the casing when the vacuum pump is in a compressed position, the chamber extending substantially out from the casing when the vacuum pump is in an extended position, the chamber having a bottom forming an aperture therein; and a piston slidably coupled within the chamber, the piston including an enlarged upper portion generally parallel to the chamber bottom, the piston further including a hollow shaft extending from a bottom surface of the upper portion, the shaft having a first end adjacent to the enlarged upper portion and a second opposing end, the shaft fitting within the chamber aperture and the casing aperture, the shaft including at least one aperture positioned at the first end, the second end of the shaft being fixed relative to the casing at the casing aperture, wherein the vacuum pump is configured to evacuate air from a flexible storage container by pushing the chamber in a downward direction to the compressed position such that the air is pulled through the aperture formed in the bottom of the casing and through the second end of the shaft into a sub-chamber positioned between the bottom surface of the upper portion of the piston and the bottom of the chamber through the at least one aperture positioned at the first end of the shaft.

2. The vacuum pump of claim 1, further comprising a fluid separator coupled to the casing bottom.

3. The vacuum pump of claim 2, wherein the fluid separator includes a generally flat face having a border, the border having a varying height.

4. The vacuum pump of claim 2, wherein the fluid separator includes one or more hollow pegs positioned within an interior of the fluid separator.

5. The vacuum pump of claim 1, further comprising a spring positioned adjacent to a top surface of the upper portion of the piston.

6. The vacuum pump of claim 5, further comprising a lid positioned over the spring, the lid being coupled to a top of the chamber.

7. The vacuum pump of claim 6, wherein the lid includes a feature for coupling the lid to the casing whereby the vacuum pump is maintained in a compressed position.

8. The vacuum pump of claim 1, wherein a top of the upper portion of the piston includes one or more apertures.

9. The vacuum pump of claim 8, further comprising an O-ring coupled to a side of the upper portion of the piston.

10. A vacuum pump comprising:

a fluid separator;

a casing having a casing aperture formed on a bottom thereof, the fluid separator being coupled to the bottom of the casing;

a chamber slidably coupled within a top of the casing, the chamber being positioned generally inside of the casing when the vacuum pump is in a compressed position, the chamber extending substantially out from the casing when the vacuum pump is in an extended position, a bottom of the chamber having a chamber aperture formed thereon; and a piston slidably coupled within the chamber, a hollow shaft of the piston extending through the casing aperture and the chamber aperture, the shaft including at least one aperture positioned at a first end, an opposing second end of the shaft being fixed relative to the casing at the casing aperture, wherein the vacuum pump is configured to evacuate air from a flexible storage container by pushing the chamber in a downward direction to the compressed position such that the air is pulled through the aperture formed in the bottom of the casing and through the second end of the shaft into a sub-chamber positioned between the piston and the bottom of the chamber through the at least one aperture positioned at the first end of the shaft.

11. The vacuum pump of claim 10, wherein the fluid separator includes a generally flat face having a border, the border having a varying height.

12. The vacuum pump of claim 10, wherein the fluid separator includes one or more hollow pegs positioned within an interior of the fluid separator.

13. The vacuum pump of claim 10, wherein the fluid separator is selected based on a type of valve on a flexible storage container with which the vacuum pump is to be used.

14. The vacuum pump of claim 10, wherein the piston includes an enlarged, generally flat upper portion, the upper portion being generally perpendicular to the shaft.

15. The vacuum pump of claim 14, wherein the upper portion of the piston includes one or more apertures.

16. A vacuum system comprising:

a vacuum pump having a casing, a bottom of the casing having a casing aperture formed thereon, the vacuum pump further having a chamber slidably coupled within a top of the casing, the chamber being positioned generally inside of the casing when the vacuum pump is in a compressed position, the chamber extending substantially out from the casing when the vacuum pump is in an extended position, a bottom of the chamber having a chamber aperture formed thereon, the vacuum pump further having a piston slidably coupled within the chamber, a hollow shaft of the piston extending through the casing aperture and the chamber aperture, the piston being fixed relative to the casing, the shaft including at least one aperture positioned at a first end, an opposing second end of the shaft being fixed relative to the casing at the casing aperture;

a fluid separator having one or more apertures formed on a bottom face, the fluid separator being coupled to the bottom of the casing; and a first flexible storage container defining an interior space configured to be in fluid communication with the one or more apertures formed on the bottom face of the fluid separator, wherein the vacuum pump is configured to evacuate air from the flexible storage container by pushing the chamber in a downward direction to the compressed position such that the air is pulled through the aperture formed in the bottom of the casing and through the second end of the shaft into a sub-chamber positioned between the piston and the bottom of the chamber through the at least one aperture positioned at the first end of the shaft.

17. The vacuum system of claim 16, wherein the bottom face of the fluid separator includes a border having a varying height.

18. The vacuum system of claim 16, wherein the fluid separator includes one or more hollow pegs positioned within an interior of the fluid separator.

19. The vacuum system of claim 16, wherein the flexible storage container includes a one-way valve, the one-way valve configured to be coupled to the fluid separator.

20. The vacuum system of claim 19, wherein the fluid separator is configured to form a seal with the one-way valve.

21. The vacuum system of claim 19, further comprising a second fluid separator configured to be used with a second flexible storage container, the second flexible storage container having a different type of one-way valve than the first flexible storage container.

22. The vacuum system of claim 21, further comprising the second flexible storage container.

23. The vacuum system of claim 16, wherein the flexible storage container is a storage bag including embossed channels.

24. The vacuum system of claim 16, further comprising a second flexible storage container, the second flexible storage container having a different size than the first flexible storage container.

* * * * *

UNITED STATES PATENT AND TRADEMARK OFFICE

CERTIFICATE OF CORRECTION

PATENT NO. : 8,740,591 B2
APPLICATION NO. : 12/052523
DATED : June 3, 2014
INVENTOR(S) : Blythe It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1395 days.

Signed and Sealed this
Twenty-eighth Day of July, 2015

Michelle K. Lee

Michelle K. Lee
*Director of the United States Patent and Trademark Office*